US008283542B2

(12) United States Patent
Woodland et al.

(10) Patent No.: US 8,283,542 B2
(45) Date of Patent: Oct. 9, 2012

(54) AJUSTABLE BRIDGE FOR A STRINGED INSTRUMENT

(76) Inventors: John Woodland, Minneapolis, MN (US); Mario Costello, St. Paul, MN (US)

( * ) Notice: Subject to any disclaimer, the term of this patent is extended or adjusted under 35 U.S.C. 154(b) by 276 days.

(21) Appl. No.: 12/387,207

(22) Filed: Apr. 29, 2009

(65) Prior Publication Data

US 2010/0275756 A1 Nov. 4, 2010

(51) Int. Cl.
*G10D 13/02* (2006.01)

(52) U.S. Cl. ..... 84/411 R

(58) Field of Classification Search ..... 84/312 R, 84/313

See application file for complete search history.

(56) References Cited

U.S. PATENT DOCUMENTS

| | | | | |
|---|---|---|---|---|
| 2,793,557 | A | 5/1957 | Stipetic | |
| 2,846,915 | A | 8/1958 | Daria | |
| 2,972,923 | A | 2/1961 | Fender | |
| 3,290,980 | A * | 12/1966 | Fender | 84/307 |
| D236,212 | S | 8/1975 | Beigel | |
| 4,069,733 | A | 1/1978 | Quan | |
| 4,457,201 | A | 7/1984 | Storey | |
| 4,512,232 | A | 4/1985 | Schaller | |
| D280,107 | S | 8/1985 | Tanaka | |
| 4,677,891 | A | 7/1987 | Gresett | |
| 4,688,461 | A | 8/1987 | Stroh | |
| 4,690,027 | A | 9/1987 | Ido | |
| 4,724,737 | A | 2/1988 | Fender | |
| 4,779,506 | A | 10/1988 | Takeuti | |
| 4,882,967 | A | 11/1989 | Rose | |
| 4,955,275 | A | 9/1990 | Gunn | |
| 5,052,260 | A | 10/1991 | Cipriani | |
| D324,693 | S | 3/1992 | Rose | |
| 5,460,072 | A | 10/1995 | Ferdon | |
| 5,939,653 | A | 8/1999 | Chang | |
| 6,068,549 | A * | 5/2000 | Jackson | 451/398 |
| 7,045,693 | B2 * | 5/2006 | Rose et al. | 84/298 |
| 2006/0236841 | A1 * | 10/2006 | LeBlanc | 84/298 |

FOREIGN PATENT DOCUMENTS

| | | | | |
|---|---|---|---|---|
| WO | WO 2010/083295 A2 * | 7/2010 | | 84/313 |

* cited by examiner

*Primary Examiner* — Kimberly Lockett
(74) *Attorney, Agent, or Firm* — Michael J. Sullivan

(57) ABSTRACT

The present invention provides a reliable, easily adjustable bridge for a string instrument and preferably a guitar and even more preferably a six-string electric guitar. The adjustable bridge of the present invention allows for adjustment of string length using only four intonation adjustment screws.

20 Claims, 7 Drawing Sheets

AJUSTABLE BRIDGE FOR A STRINGED INSTRUMENT

FIELD OF THE INVENTION

This invention relates generally to an adjustable bridge assembly for use in string instruments and guitars in particular. The adjustable bridge of the present invention allows the length of each string to be adjusted individually thereby assuring that the correct pitch will be attained at each fret position of the guitarist's fingers, while eliminating string buzzing and improving playability.

BACKGROUND

Typically a stringed instrument, such as a guitar, comprises of a series of strings that are strung under tension over a fret board being supported by a nut and saddles of the bridge. The bridge and saddle not only support the strings, but are also important in assuring proper intonation of the guitar strings. The effective string length must be closely controlled in order that the instrument will have the correct octave adjustment. Proper intonation is achieved by fixing the distance of the string from the nut to the bridge. When string distance is accurately fixed can the guitar produce its optimum sound. Adjustable bridges are available for increasing or decreasing the distance from the nut to the bridge allowing the intonation of individual strings to be adjusted. Adjustable bridges may also be used to adjust the height of the strings above the fretboard.

One example of an adjustable bridge is disclosed in U.S. Pat. No. 2,972,923 which discloses a "floating" bridge for use with a vibrato which allows the strings to move during vibrato use. To accomplish this coordinated movement the bridge pivots or rocks on a pair of mounting posts, the diameter of which are smaller than the thimbles into which they were inserted. By coordinating the movement of the strings and the vibrato, the floating bridge reduces the amount of friction imposed by the saddle on the strings when the vibrato is used. Each string is support by a threaded barrel. The intonation of each individual string is adjusted by moving the threaded barrel fore or aft by turning a screw associated with the barrel. In this manner the length of each string is adjusted individually be turning a screw and moving the associated barrel. The height of each string is also adjusted individually by turning a pair of height adjustment screws associated with each barrel.

Use of prior art adjustable bridges with certain guitar styles, particularly those equipped with vibratos, results in adequate string tension being applied to each of the individual barrels of the bridge. The lack of tension may result in strings being displaced from their associated barrel during playing. The lack of tension may also cause one or both barrel height adjustment screws to loosen during playing. The loosening of the height adjustment screws may cause unwanted string vibration and decreased sound quality.

The need to adjust the length and height of each string individually by adjusting either one or two screws associated with each barrel also makes proper intonation adjustment difficult and time consuming. Further, the position and arrangement of barrel length adjustment screws in prior art bridges relative to the strings made them difficult to access and often resulted in unwanted contact between the strings and the screw during playing.

Accordingly, what is needed is an adjustable bridge that improves the amount of tension applied by the strings to the saddle elements, thereby preventing the strings from becoming displaced during playing, reducing unwanted string vibration and improving sound quality. What is also need is an adjustable bridge that is easily and quickly adjusted and minimizes or eliminates contact between the strings and the adjustment means.

SUMMARY OF THE INVENTION

This invention relates to guitars and the like and to adjustable bridge constructions therefore. An object of the invention is to provide an adjustable bridge which does not adversely affect the quality of the generated sound, being adapted to adjust individually the length of each string to thereby assure that the correct pitch will be attained at each fret position of the guitarist's fingers and also to determine the elevations of such strings and the exact spacing there between.

A further object is to provide a six-string electric guitar incorporating the adjustable bridge of the present invention and which may be employed in conjunction with a vibrato means. The bridge of the present invention permits a high degree of adjustability, which solves the problems associated with existing bridges. Accordingly, the present invention provides in one embodiment a reliable, easily adjustable bridge comprising a base member having a recessed portion disposed between first and second sidewalls; a pair of unitary saddle elements disposed in the recessed portion, each saddle element having a plurality of grooves on its upper surface, the grooves being substantially parallel to the strings and adapted to receive the strings, each unitary saddle element having a height adjustment means for adjusting the height of the saddle element and an intonation adjustment means for adjusting the axial position of the saddle element; and a means for mounting the base member to the instrument.

According to one embodiment of the present invention the adjustable bridge comprises four intonation-adjustment screws instead of six intonation-adjustment screws in the prior art. The four intonation-adjustment screws operate independently of one another to allow for precise intonation adjustment. In a preferred embodiment precise intonation adjustment is achieved by adjusting the axial position of each unitary saddle element using an intonation adjustment means comprising a swivel, an intonation adjustment screw and a compression spring disposed there between. In a preferred embodiment each unitary saddle element is adapted to receive a pair of swivels, with each swivel receiving the shank end of an intonation adjustment screw. The swivels, which are disposed in the saddle element and receive the intonation-adjustment screws, permit the intonation-screws to independently adjust the fore-aft position of the saddle elements.

In another embodiment of the present invention each saddle element comprises three grooves disposed on the upper surface thereof, the grooves effectively dividing the saddle element into four barrels wherein the second and third barrels are adapted to receive an intonation adjustment means and the first and fourth barrels elements are adapted to receive a height adjustment means. Preferably, the height adjustment means comprises a pair of threaded screws rotatably mounted in the first and fourth barrel elements whereby rotation of the screw affects the height of the associated barrel and the intonation adjustment means comprises a pair of threaded screws rotatably mounted in a pair of swivels disposed in the second and third barrels whereby rotation of the screw affects the fore-aft or axial position of the associated barrel.

In other embodiments the invention provides a bridge assembly comprising mounting posts for affixing the channel member of the bridge assembly to the instrument. Preferably the mounting posts are adjustable and removable via a vented button head screw. The head screw contains a vent allowing internal access to an adjustable bass/treble height screw which is disposed inside a threaded hollow body.

BRIEF DESCRIPTION OF THE DRAWINGS

One will better understand these and other features, aspects, and advantages of the present invention following a review of the description, appended claims, and accompanying drawings in which:

DETAILED DESCRIPTION

Figure 1:
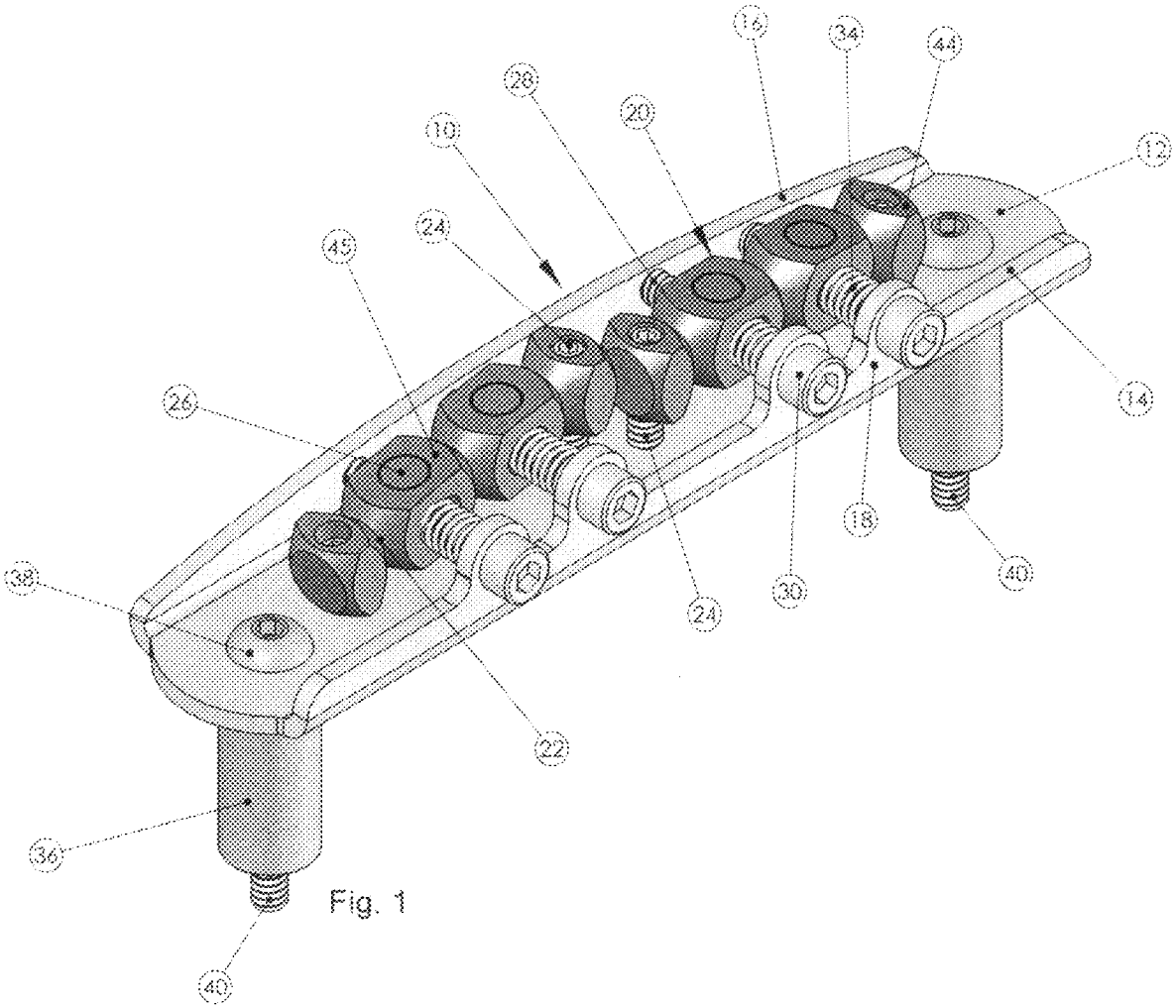
FIG. 1 shows a bridge assembly according to one embodiment of the present invention.

The present invention solves the problems associated with existing bridges and provides a reliable, easily adjustable bridge for a string instrument and preferably a guitar and even more preferably a six-string electric guitar. However, aspects of the present invention are applicable to either or both electric and acoustic guitars, and similar stringed instruments, having various numbers of strings. Thus, the description of a feature of the invention relative to a particular type of guitar (such as a six-string electric guitar) does not preclude use of such feature on another type of guitar or other stringed instrument. Further, aspects of the present invention are equally applicable to electric guitars embodying vibrato means as well as those that do not.

The bridge 10 is illustrated to comprise a channel member 12 (forming a bridge base, also referred to as a base member) lying between a pair of sidewalls. In one embodiment the channel member 12 is affixed to the body of the musical instrument by a mounting means such as a screw or other fastener, while in other embodiments the channel member 12 is supported on leg or post assemblies 36. The leg or post assemblies may be either integral to, or removably affixed to, the channel member 12. In a preferred embodiment such assemblies 36 include internally-threaded tubular elements 42 which are fixedly secured to opposite ends of the web of channel 12, and externally-threaded pin or screw elements 40 threaded into tubes 42. The upper ends of the pins 40 are socketed for reception of a wrench so that the elevation of the channel may be adjusted turning the pin 40. Accordingly, in a preferred embodiment the mounting posts 36 are adjustable and removable via a vented button head screw 38. The threaded tubular element 42 which receives the head screw 38 on one end contains a vent allowing internal access to the adjustable height screw 40. The leg or post assemblies 36 extend downwardly into relatively large-diameter sockets or thimbles 54 which are fixedly mounted in the guitar body 50, the relationship being such that the lower pointed ends of screw elements 40 seat in the bottom portion of the thimbles. Preferably the diameter of the post assembly is such that it fits snuggly inside the thimble 54, thereby preventing the bridge from rocking or pivoting in response to lengthening or shortening of the strings or in response to strumming of the strings. It is to be understood that minimizing the movement of the saddle assembly more string vibration energy transferred to the guitar body improving resonance and sound quality.

The bridge assembly further comprises a pair of saddle elements 20 mounted longitudinally on the web of channel 12. Each saddle element 20 is cable of supporting a plurality of guitar strings 52 and positions the strings 52 to adjust their length. Preferably, but not necessarily, plurality of guitar strings 52 are received by a plurality of grooves 22 recessed in the upper portion of each of the saddle elements 20. It is to be understood that the grooves 22 receive the strings 52 and prevent them from being displaced when the strings 52 are strummed by the guitarist. It is also to be understood that he grooves 22 provide for a contact point between the saddle elements 20 and the strings 52 thereby permitting the strings to be lengthened and shortened when the saddle elements 20 are adjusted.

Figure 2:
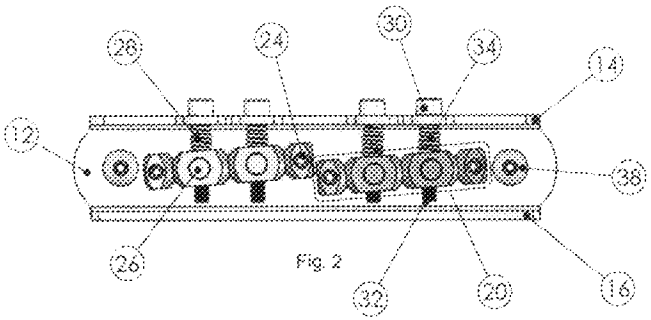
FIG. 2 shows a top perspective view of a bridge assembly according to one embodiment of the present invention.
Figure 3:
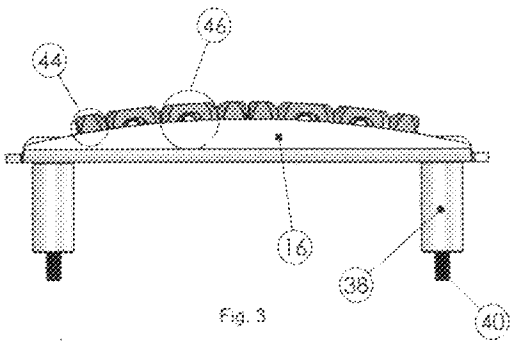
FIG. 3 shows a side perspective view of one embodiment of the present invention.
Figure 4:
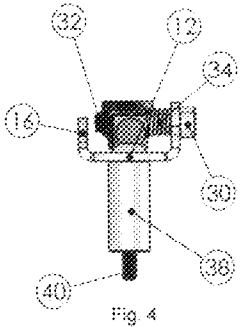
FIG. 4 shows a side perspective view of one embodiment of the present invention.
Figure 5:
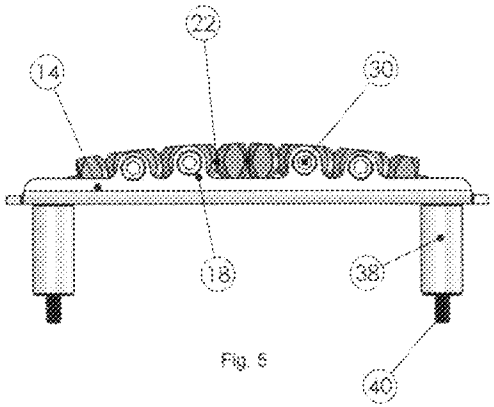
FIG. 5 shows a side perspective view of one embodiment of the present invention.
Figure 6:
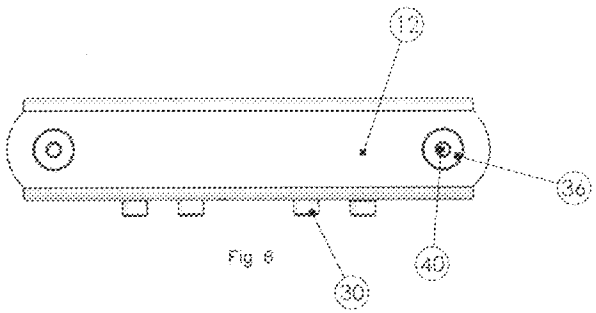
FIG. 6 shows a bottom perspective view of one embodiment of the present invention.
Figure 9:
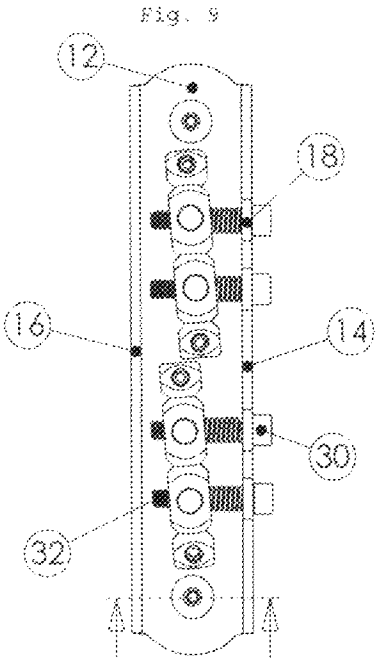
FIG. 9 shows a top perspective view of a bridge assembly according to one embodiment of the present invention.
Figure 11:
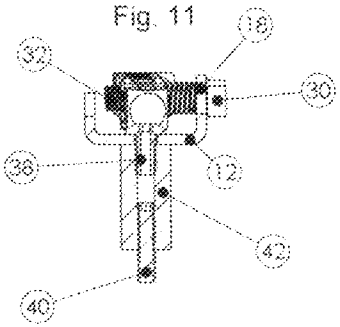
FIG. 11 shows a detailed side perspective view of a mounting post assembly according to one embodiment of the present invention.
Figure 12:
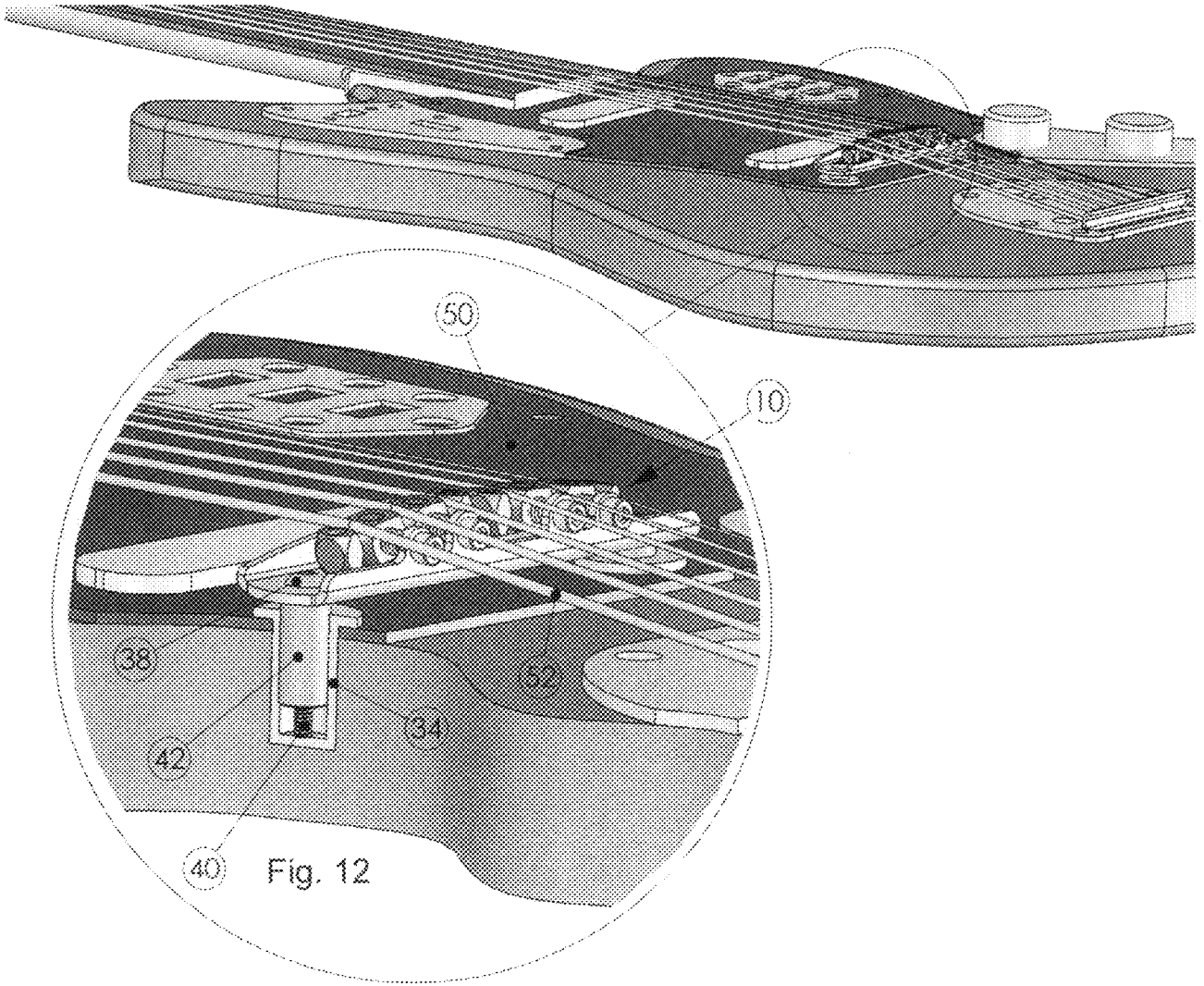
FIG. 12 shows cut away view of musical instrument equipped with a bridge assembly according to one embodiment of the present invention.

The channel member further comprises a pair of sidewalls 14, 16, the first side wall 14 having a plurality of flanges 18 formed along its face. The flanges 18 are adapted to receive an intonation adjustment screw 28, which joins the saddle elements 20 to the first sidewall 14 of the base member 12. The saddle elements 20 are mounted in end-to-end relationship and substantially parallel to the sidewalls 14, 16, as illustrated in FIGS. 1, 2. The fore-aft and axial position of the saddle elements 20 however, is adjustable according to the present invention and therefore the position of the saddle elements may not necessarily lie parallel to the sidewalls 14, 16, but rather each element may be slightly a skewed as illustrated in FIGS. 2 and 9.

It is a feature of the invention that an intonation adjustment means are provided to maintain the saddle elements in the precise positions to which they are adjusted by screws indicated at 28; thereby the effective string length may be closely controlled in order that the instrument will have the correct octave adjustment. Such screws 28 extend through openings in one of the flanges 18 of the first side wall 14 and received by a swivel 26 disposed in the saddle element 20. The swivel 26 has a transverse opening 58 that is internally-threaded and receives the shank end 32 of the intonation adjustment screw 28. The screws 28 are further secured by a comprising helical compression springs 34 mounted, respectively, around the shanks of screws 32 such that when the screw 28 is seated the spring 34 is disposed between saddle element 20 and the flange 18 through which the screws 28 project. In one embodiment, the ends of the springs 34 seat in counterbores which are provided in the saddle elements 28.

Figure 15:
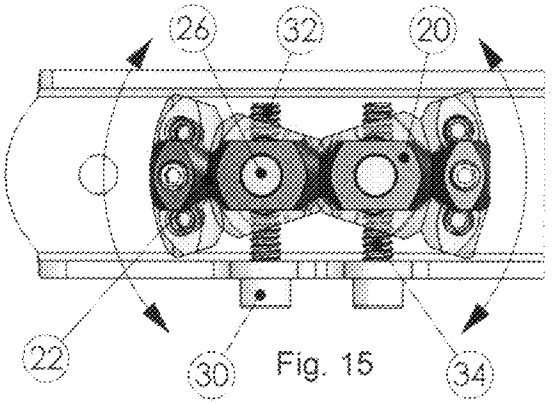
FIG. 15 shows a detailed top view of an adjustable bridge according to one embodiment of the present invention.

Because of the presence of swivels 26 the saddle elements 20 may be adjusted through a very substantial distance toward and away from the associated channel flange in order to change relatively greatly the operative lengths of the strings. Thus, for example, as illustrated in FIG. 15, it is possible to turn an adjustment screw to position the saddle element 20 close to the flange 18 through which the screws 28 project. As further illustrated in FIG. 15, it is possible by turning the two intonation adjustment screws 28 to effectively adjust the operative length of three strings. Such adjustment would not be possible using bridges of the prior art, which required each string to be adjusted individually by turning an intonation adjustment screw.

The present invention further provides a bridge capable of adjusting the height of the strings. It is also to be understood that the strings are preferably at different heights because they lie along the surface of an imaginary large diameter cylinder, such imaginary cylinder being generally concentric with the upper surface of the fret board. The upper fret board surface is curved, as viewed in section. Accordingly, in a preferred embodiment the upper edge of the second sidewall 16 is curved and has continuous radius from about 7 to about 14 inches, while the first side wall has a plurality of intonation screw mounting means. In certain embodiments the intonation screw mounting means are designed so as to minimize or eliminate contact with the strings.

To ensure that the strings rest properly along the saddle elements the string height is adjusted via a height adjustment means comprising a pair of height adjustment screws 24 disposed in each of the saddle elements. Preferably the height adjustment screws are threaded and transversely extend through a threaded opening in the saddle element 20. The upper ends the screws 24 are preferably socketed for reception of a wrench so that the elevation of the saddle element 20 may be adjusted by turning the screw 24. The elevation of the strings 52 above the face of the guitar body 50 and above the neck 56 may also be altered by rotating the post height adjustment screws 40 to raise or lower the entire channel 12.

Now turning to FIG. 1, which illustrates one embodiment of an adjustable bridge 10 according to the present invention. The embodiment illustrated in FIG. 1 provides an adjustable bridge 10 wherein the string lengths are readily adjustable with precision and without interference between the bridge and the strings. The bridge 10 is of low mass and is devised to apply negligible torque to the body face of the guitar. Vibrations are applied directly to the face of the instrument and not through a series of layers or connecting elements.

The base member 12 in FIG. 1 serves to mount the bridge to the guitar and provides an attaching point for the intonation adjustment screws 28. In a preferred embodiment the base member 12 is a single piece, but could be constructed of multiple cooperating pieces. In a preferred embodiment the base member 12 comprises a first side wall 14, which has a plurality of flanges 18 for receiving the intonation adjustment screws 28. The base member also preferably has a pair of mounting holes for receiving mounting screws 38 which couple the base member 12 to the guitar body. This arrangement of mounting screws 38 is advantageous where pre-existing holes for a previous bridge may be reused.

The sidewalls 14, 16 of the base member 12 define a recessed portion that is adapted to receive a pair of unitary saddle elements 20. The unitary saddle elements 20 are located in the recessed portion of the base member 12 between the sidewalls 14, 16. The unitary saddle elements are preferably formed from a single piece of corrosion resistant metal such as stainless steel and are capable of supporting a plurality of guitar strings. Accordingly, in a preferred embodiment each saddle element 20 has a plurality of grooves 22 recessed into its upper surface. In a preferred embodiment the grooves 22 have a long axis that is orientated substantially parallel to the direction of the strings and perpendicular to the side walls 14, 16. In a preferred embodiment the grooves 22 are preferably shaped to receive a guitar string and in particularly preferred embodiment have tapered sidewalls such that grooves 22 decrease in width from the upper surface of the saddle element to the terminus of the groove. The grooves 22 may vary in depth from about 0.02 to about 0.1 inches below the surface of the saddle element. In a preferred embodiment the grooves 22 have a depth of about 0.03 inches. In other embodiments the grooves 22 have tapered sidewalls which result in the grooves having a substantially v-shape when viewed from the front or the back. The angle of the v-shaped groove may vary from about 90 to about 60 degrees and more preferably from about 80 to 85 degrees. In one embodiment the bottom of the v-shaped groove may be rounded, resulting in the bottom of the groove having a concave shape having a radius from about 0.01 to about 0.1 inches.

Further referring to FIG. 1, the pair of saddle elements 20 are held in an end-to-end relationship in the recessed portion of a base member 12, preferably however, the saddle elements 20 do not touch one another. Each saddle element 20 is attached to the first side wall 14 by a pair of intonation adjustment screws 28 that pass through flanges 18 extending from the first sidewall 14 of the base member. In a preferred embodiment the saddle elements 20 do not bear directly against the recessed portion of the base member 12, rather each saddle element 20 is supported by a pair of height adjustment screws 24.

In a preferred embodiment each saddle element 20 includes a plurality of grooves 22 that extend circumferentially around the saddle element effectively dividing each saddle element 20 into barrels. In a preferred embodiment each saddle element 20 has three grooves 22 extending circumferentially there-around dividing the saddle element 20 into four barrels 44, 45, 46 and 47. A string 52 extends over each groove 22, resting between the barrels. Preferably the strings are secured immediately behind the point at which they contact the grooves 22 so that little torque is imposed on the saddle element 20 by the strings 52.

In a particularly preferred embodiment each groove 22 has convex sidewalls formed from the edge of adjacent barrels as illustrated in FIGS. 13-16. It is preferred that the radius of the sidewalls of the grooves 22 is uniform amongst the grooves 22. The radius, however, need not be uniform throughout the groove; the radius may be varied amongst the grooves to accommodate various string diameters. Preferably the groove 22 is sufficiently deep to receive and seat the string 52 and to prevent the string 52 from being displaced when strummed. It is to be understood that by providing sidewalls having a radius, as opposed to sidewalls that are substantially planar, that undo interference with the strings will be avoided when the axial position of the saddle element is adjusted. As best illustrated in FIG. 15 when the saddle element 20 is adjusted axially, the curved sidewalls of the grooves 22 permit adjustment of the strings without undo interference by the saddle element 20. It is also to be understood that the shape of the grooves 22 permit movement of the strings when the saddle is used in conjunction with a vibrato means. This arrangement is particularly effective where a vibrato means is used and the post assembly 36 snuggly fit with the thimble 54, thereby minimizing movement of the bridge.

Figure 14:
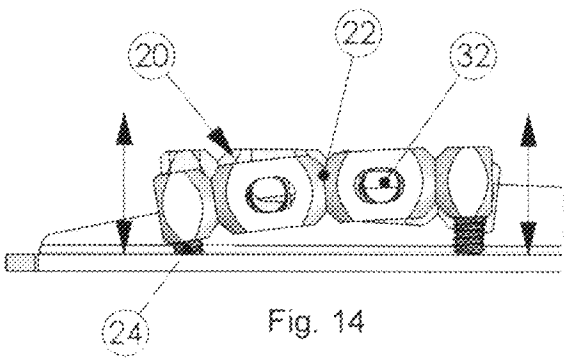
FIG. 14 shows a detailed front view of an adjustable bridge according to one embodiment of the present invention.

In one embodiment the first 44 and fourth 47 barrels include a longitudinally extending threaded opening adapted to receive a height adjusting screw 24. Preferably the longitudinal opening is substantially perpendicular to the horizontal axis of the barrel 44, 47. In other embodiments, however, the longitudinal opening may be inclined so as to form an acute angle with respect to the longitudinal axis of the barrel 44, 47. Height adjustment is accomplished much more easily as a result of this construction because the strings do not impede access to the adjusting screws 24. Also the height of each saddle element 20 may be adjusted independently of the height of the entire saddle assembly 10. As illustrated in FIG. 14, by rotating the height adjustment screw 24 the position of the saddle element 20 can be varied and the effective height of the string can be controlled.

In a preferred embodiment the upper surface of the saddle element 20 is not planar, but rather has a radius from about 7 to about 9 inches. It is to be understood that by varying the radius of the saddle element 20 in combination with adjusting the height of the saddle element 20 using the height adjustment screws 24, the adjustable bridge 10 of the present invention may be used to accommodate nearly any common fingerboard radius. It is also believed that by curving the individual saddle elements 20 the annoying "buzzing" or rattle associated with prior art designs may be eliminated.

Turning now to FIGS. 2 through 6, which illustrate several views of a bridge assembly 10 according to one embodiment of the present invention. As illustrated in FIGS. 2 through 6 the bridge assembly 10 comprises a pair of saddle elements 20 disposed between the first 14 and second 16 sidewalls. Preferably each saddle element 20 has three grooves 22 disposed on its upper surface, effectively dividing each saddle element 20 into four barrels 44, 45, 46 and 47. Preferably the grooves 22 are v-shaped and have convex sidewalls orientated substantially parallel to the orientation of the strings 52. Each saddle element 20 is joined to the first sidewall 14 by a pair of intonation screws 28, which pass through a pair of flanges 18 of the first sidewall 14 and into a pair of threaded swivels 26 disposed in each of the saddle elements 20. A compression spring 34 is disposed on each of the intonation adjustment screws 28 and positioned between the flange 18 and the swivel 26. The bridge assembly 10 is affixed to the body 50 of a musical instrument via a pair of mounting assemblies 36. Such assemblies 36 may include, in a preferred embodiment, internally-threaded tubular elements 42 that are secured to opposite ends of the channel 12 by removable mounting screws 38. Disposed within the tubular elements 42 is an externally-threaded pin or screw elements 40. The upper ends of the pins 40 are socketed for reception of a wrench, so that the elevation of the channel 12 may be adjusted by rotating the pin 40. Accordingly, in a preferred embodiment the mounting posts 36 are adjustable and removable via a vented button head screw 38.

Figures 7, 8:
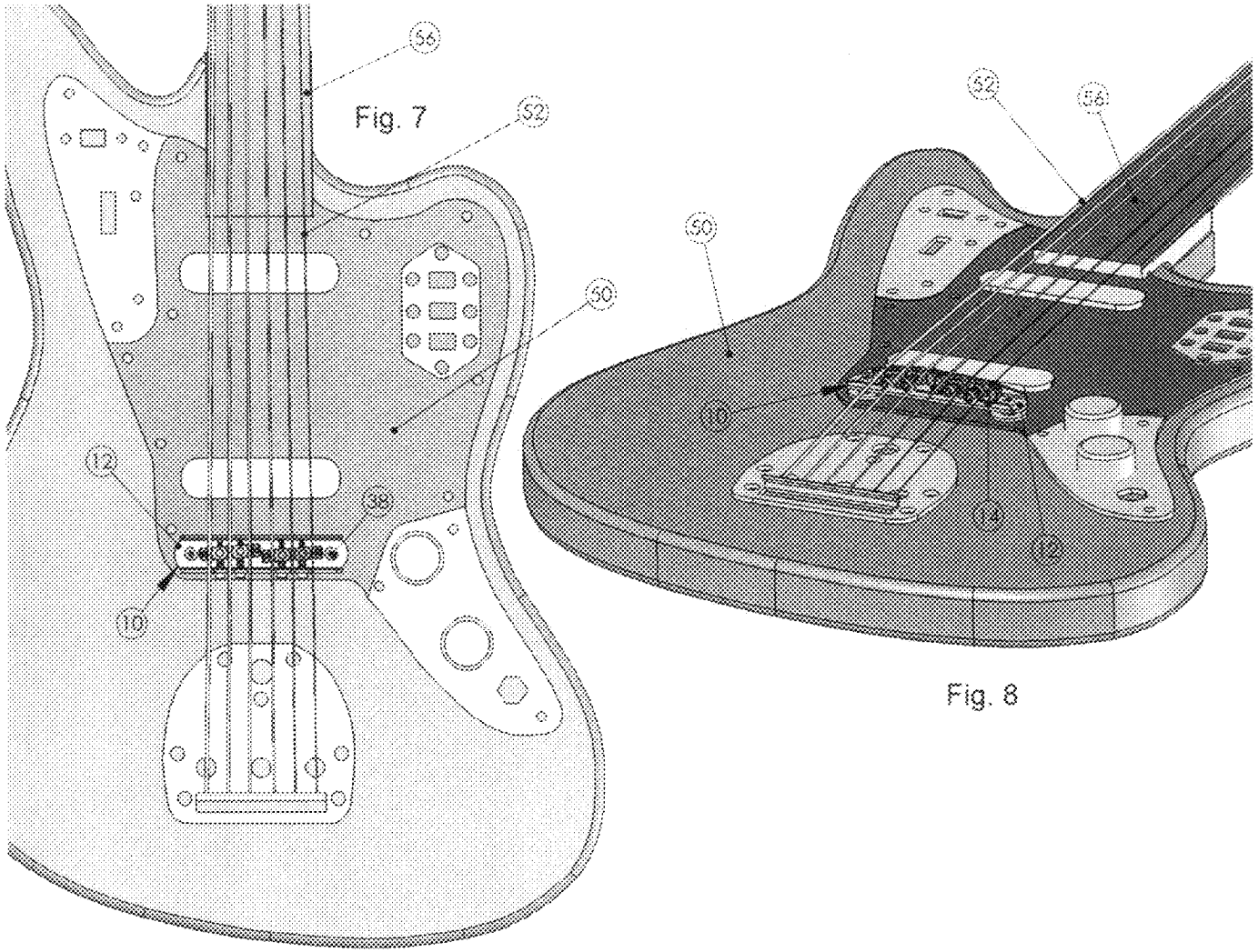
FIG. 7 shows a top perspective view of a musical instrument equipped with a ridge assembly according to one embodiment of the present invention.
FIG. 8 shows a side perspective view of a musical instrument equipped with a ridge assembly according to one embodiment of the present invention.

With reference to FIG. 8 there may be seen an electric guitar having a solid wooden body 50 from which extends a neck 56. An adjustable bridge 10 according to one embodiment of the present invention is located near the base of the neck 56. A plurality of steel strings 52 extend from the string plate to the adjustable bridge 10 mounted on the top face of the instrument. As further illustrated in FIG. 8, the bridge 10 includes a base member 12 affixed to the top face of the instrument generally transversely of the strings 52. The base 12 is provided with a central recess and a pair of substantially parallel side walls 14 and 16. Disposed within the recess between the side walls 14, 16 are a pair of saddle elements 20. Preferably the saddle elements 20 are formed from a durable and corrosion resistant material, such as stainless steel or chrome, the centers of which have been drilled out to accommodate the height adjustment and intonation adjustment means. Hence, the saddle elements 20 are strong and rigid but light in weight. These saddle elements 20 are arranged in end-to-end relationship, but preferably do not contact one another. In a particularly preferred embodiment ach saddle element 20 has a plurality of grooves 22 disposed on its upper surface; the grooves 22 are substantially parallel to the strings 52 and adapted to receive the strings 52.

Figure 10:
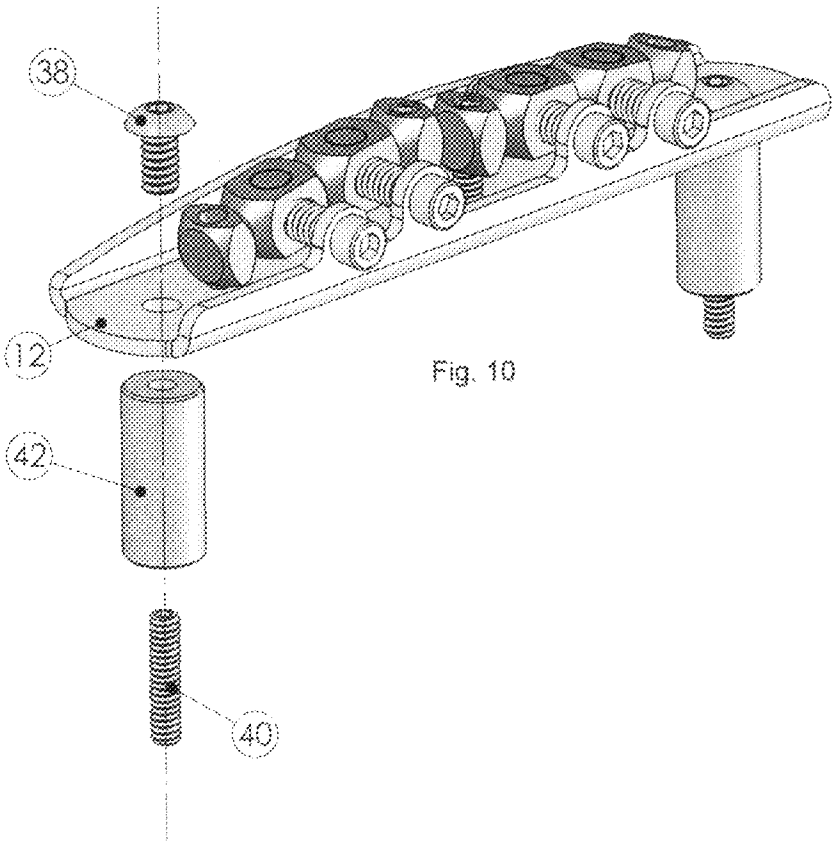
FIG. 10 shows a detailed view of a mounting post assembly according to one embodiment of the present invention.

Turning now to FIG. 10, one preferred configuration of the first sidewall 14 is illustrated. According to he illustrated embodiment the first sidewall 14 comprises four separate mounting flanges 18, wherein each mounting flange 18 is adapted to receive an intonation adjustment screw 28. Such second sidewall 14 and associated flanges 18 forms an intonation screw-mounting means. Preferably the screw 28 rotatably mounted in the flange 18, but is not threaded therein, and the head end 30 of the screw abuts the flange. The flanges 18 of sidewall 14 permit each intonation adjustment screw to enter an associated saddle barrel of the saddle element 20 at one side of the axial midportion of the barrel. Preferably the intonation screws 28 enter the midportions of the second 45 and third 46 barrels of the saddle element 20.

Figure 16:
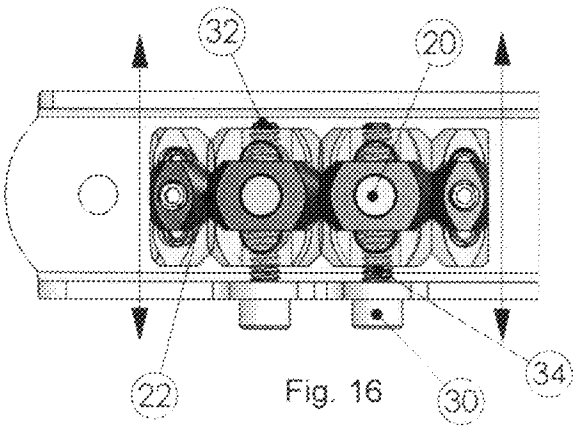
FIG. 16 shows a detailed top view of an adjustable bridge according to one embodiment of the present invention.
Figure 13:
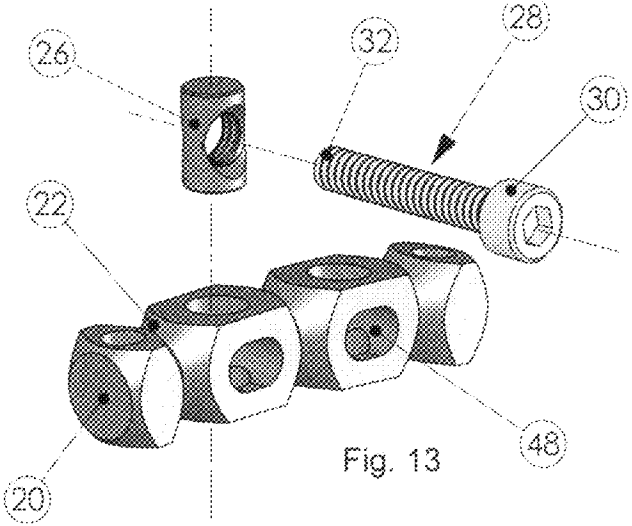
FIG. 13 shows an exploded view of an intonation adjustment means according to one embodiment of the present invention.

A preferred embodiment of the intonation adjustment means is illustrated in FIGS. 13, 15 and 16. As illustrated in FIG. 13, the barrel is fitted with a swivel 26 having a transverse threaded opening that is adapted to receive the shank end 32 of the intonation adjustment screw 28. The swivel 26 allows the saddle element 20 to pivot when the intonation adjustment screw 28 is turned. A swivel 26 is received by in the second 45 and third 46 barrels via a longitudinal hole 58 in the barrels 45, 46. The barrels 45, 46 also have a transverse hole 60 that allows the shank end 32 of the intonation adjustment screw to pass through the barrel and to be received by the swivel. Preferably the transverse hole 60 is oval shaped to permit the axial movement of the saddle element 20 when the intonation adjustment screw 28 is turned as illustrated in FIG. 15.

The arrangement of the screw-mounting means head end 30 of the intonation adjustment screws 28 reduces the likelihood of contact between the strings 52 and the head end 30 of the intonation adjustment screws 28. At the same time the intonation adjustment screws 28 are easily accessible and readily movable so that the octave adjustment of the instrument can be effected easily and with great precision. Simply by rotating the adjusting screws 28, which are accessible from the rear of the bridge 10 away from the strings 52, the relative positions of the saddle elements 20 may be varied. The length of possible adjustment is large. String length is such a critical factor that it is important to have adjustability within very precise increments of length. This is no problem with the present construction because the screws 28 may be rotated a fraction of a turn when needed in order to effectuate fine adjustment. Adjustment is accomplished much more easily as a result of this construction because the strings 52 do not impede access to the adjusting screws 28.

Figure 19:
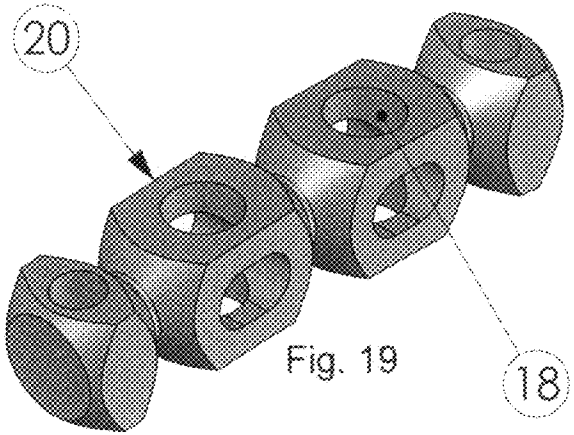
FIG. 19 shows a top perspective view of a unitary saddle element according to one embodiment of the present invention.
Figure 18:
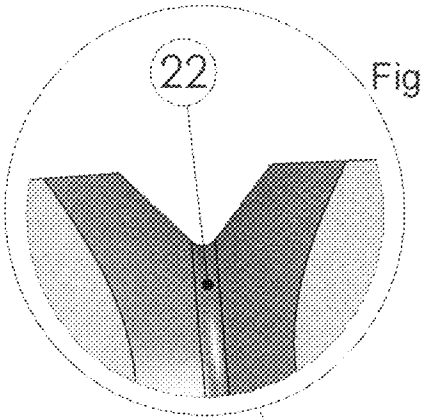
FIG. 18 shows a detailed view of a groove disposed in a unitary saddle element according to one embodiment of the present invention.
Figure 17:
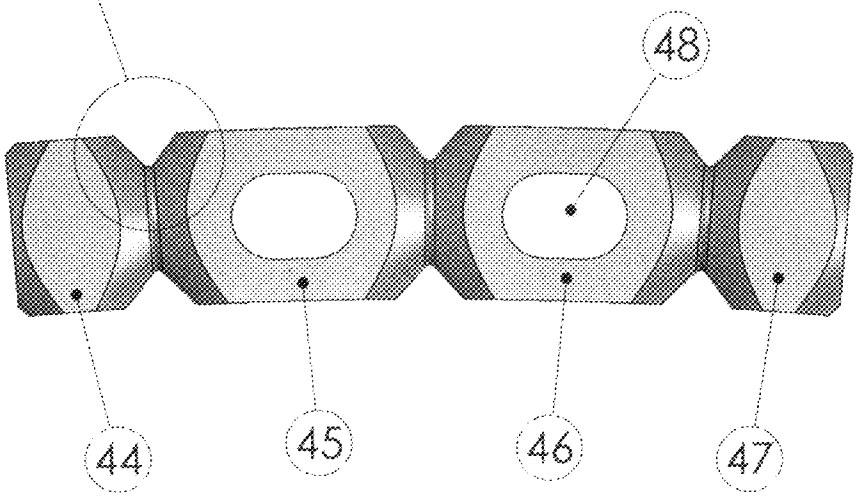
FIG. 17 shows a front perspective view of a unitary saddle element according to one embodiment of the present invention.

Turning to FIGS. 17, 18 and 19, which illustrate a preferred embodiment of the unitary saddle element of the present invention. As illustrated in FIG. 17, in one embodiment the unitary saddle element comprises three grooves 22, which divide the element into four barrels 44, 45, 46, and 47. The second 45 and third 46 barrels have a substantially horizontal opening 48, which is adapted to receive the shank end 32 of an intonation adjustment screw 28. The second 45 and third 46 barrels also have a substantially longitudinal opening, which is adapted to receive a swivel 26. FIG. 18 illustrates a detailed view of one of the grooves 22, which divide the four barrels 44, 45, 46, and 47. In a particularly preferred embodiment the groove 22 is substantially v-shaped. The angle of the v-shaped groove may vary from about 90 to about 60 degrees and more preferably from about 80 to 85 degrees. In one embodiment the bottom of the v-shaped groove may have a rounded shape resulting in the bottom of the groove having a concave shape with a radius from about 0.01 to about 0.1 inches. In a particularly preferred embodiment the grooves 22 are uniform in shape and have a depth from about 0.02 to about 0.1 inches. Although FIGS. 17, 18 and 19 illustrate the grooves 22 as being disposed continuously around the circumference of the saddle element 20, the invention is not so limited. In one embodiment the grooves 22 may be disposed only along the top portion of the saddle element 20.

The bridge 10 is adjusted in a number of ways, the first of which relates to changing the height of the strings 52 above the body of the instrument 50 or the frets of the neck 56. In this regard it is desired that the height of the individual bridge elements 20 be as close as possible to the height of the second sidewall 16 since mounting of an element 20 an excessive height above the height of the second sidewall 16 may result in undesirable results of an excessive amount of torque being transferred to an element 20. Thus, to obtain the proper height of the elements 20 relative to the second sidewall 16 and to position the strings 52 an appropriate height above the body 50, a wrench is inserted into the longitudinal opening of first or fourth barrel 44, 47 to turn the threaded height adjustment screws 24. Turning the height adjustment screw 24 causes the shank end of the screw to depress against the web channel 12, thereby elevating the saddle element 20 as illustrated in FIG. 14. The height of the entire bridge assembly may be adjusted by adjusting the height of the mounting posts 36, which is accomplished by inserting a wrench through the vented button head screw 38 to obtain access to the externally-threaded pin or screw 40 threaded into tubes 42. The guitarist may use a wrench engage the upper ends of the pins 40, which are socketed for reception of a wrench, and rotate the pin 40 thereby causing the elevation of the channel 12 to be adjusted. It is to be understood that the treble/bass height adjustment pin 40 may be adjusted without removing the button head screw 38 and without removing the bridge assembly 12 from the guitar.

Adjustment of each bridge element 20 longitudinally and axial of the instrument is effected by means of a screw 28 which is preferably rotatably inserted, not threaded, through one of the flanges 18 of the first sidewall 14 and is threaded through a swivel 26 which is seated perpendicular to the axis thereof. The guitarist begins adjusting the length of the guitar strings 52 by making minute adjustments in the lateral positions of the strings 52 on the bridge 10. This is accomplished by shifting the strings 52 in one lateral direction or the other until each of the strings 52 are seated in one of the grooves 22 disposed on the upper surface of the bridge element 20, with each groove receiving one string. The guitarist may then adjust the effective length of each string by turning the intonation adjustment screw 28 to shift the saddle element 20 longitudinally of the string. This adjustment is made with reference to string harmonics and in a manner known to the art. The friction of the string 52 upon the saddle element 20 causes the string 52 to be moved when the guitarist turns the intonation adjustment screw 28.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

We claim:

1. A bridge for supporting the strings of a stringed instrument, the bridge comprising:

a base member having first and second sidewalls;

a pair of unitary saddle elements disposed between the first and second sidewalls, each saddle element having a plurality of grooves on its upper surface;

a saddle element height adjustment means;

an intonation adjustment means; and a mounting means for mounting the base member to the stringed instrument.

2. The bridge of claim 1 wherein each unitary saddle element has three grooves disposed on its upper surface, thereby dividing the element into a first, second, third and fourth barrel.

3. The bridge of claim 2 wherein the first and fourth barrels adapted to receive the height adjustment means, and the second and third barrels are adapted to receive the intonation adjustment means.

4. The bridge of claim 2 wherein the grooves are from about 0.02 to about 0.1 inches deep.

5. The bridge of claim 1 wherein the first sidewall further comprises a plurality of flanges adapted to receive the intonation adjustment means and the second sidewall further comprises a curved upper edge having a radius from about 7 to about 14 inches.

6. The bridge of claim 1 wherein the mounting means comprises a pair of mounting posts comprising a post, a vented mounting screw and a post height adjustment screw.

7. The bridge of claim 6 wherein the post is internally threaded to receive both the vented mounting screw and the post height adjustment screw.

8. The bridge of claim 1 wherein each unitary saddle element has a radius from about 7 to about 9 inches.

9. The bridge of claim 1 wherein the intonation adjustment means comprises an intonation screw having a shank end and a head end, a swivel adapted to receive the shank end of the intonation screw and a spring disposed on the intonation screw.

10. A bridge for supporting the strings of a stringed instrument, the bridge comprising:

a pair of unitary saddle elements, each unitary saddle element having three grooves disposed on its upper surface dividing the element into first, second, third and fourth barrels, the first and fourth barrels adapted to receive a height adjustment screw, the second and third barrels adapted to receive the shank end of an intonation adjustment screw and a swivel;

a base member having a recessed portion disposed between first and second sidewalls, the recessed portion adapted to receive the pair of unitary saddle elements, wherein the first and second sidewalls are arranged substantially perpendicular to the strings, the first side wall having a radius from about 7 to about 14 inches, and the second side wall having four screw mounting means;

four intonation adjustment screws mounted in the screw mounting means;

a swivel disposed in the second and third barrels of each unitary saddle element;

a pair of height adjustment screws rotatably mounted in the first and fourth barrels of each unitary saddle element; and a pair of mounting posts.

11. The bridge of claim 10 further comprising a spring disposed on each of the four intonation adjustment screws.

12. The bridge of claim 10 wherein each mounting post comprises a post, a vented mounting screw and a post height adjustment screw.

13. The bridge of claim 10 wherein each groove has convex sidewalls formed from the edge of adjacent barrels.

14. A unitary saddle element for supporting the strings of a stringed instrument, the saddle element comprising at least three grooves disposed on the upper surface of the saddle element, the grooves dividing the saddle element into first, second, third and fourth barrel, the first and fourth barrels adapted to receive a height adjustment screw, the second and third barrels adapted to receive an intonation adjustment screw and a swivel.

15. The unitary saddle element of claim 14 further comprising a swivel disposed in each of the third and fourth barrels, the swivel being adapted to receive the shank end of an intonation adjustment screw.

16. The unitary saddle element of claim 14 wherein the grooves are substantially v-shaped and have an internal angle from about 80 to about 90 degrees.

17. The unitary saddle element of claim 14 wherein the saddle element has a radius from about 7 to about 9 inches.

18. A mounting post for removably mounting a bridge to the body of a musical instrument comprising an internally threaded barrel element, an externally threaded vented screw and an externally threaded height adjustment screw wherein the externally threaded vented screw removably engages the internally threaded barrel element thereby removably mounting a bridge to the body of a musical instrument.

19. The bridge of claim 2 wherein the grooves are substantially v-shaped.

20. The bridge of claim 19 wherein the substantially v-shaped grooves have an internal angle from about 80 to about 90 degrees.

* * * * *